US005133306A

United States Patent [19]

Honkanen

[11] Patent Number: 5,133,306

[45] Date of Patent: Jul. 28, 1992

[54] HORIZONTALLY OPPOSED INTERNAL COMBUSTION ENGINE

[76] Inventor: Eric G. Honkanen, P.O. Box 864, Gardnerville, Nev. 89410

[21] Appl. No.: 781,815

[22] Filed: Oct. 23, 1991

[51] Int. Cl.[5] ..... F02B 75/02

[52] U.S. Cl. ..... 123/51 AA; 123/51 BA; 123/53 C

[58] Field of Search ..... 123/52 A, 53 C, 51 R, 123/51 BA, 51 AA, 59 R, 59 A, 59 B, 56 AC, 56 BC, 51 BB

[56] References Cited

U.S. PATENT DOCUMENTS

| | | | |
|---|---|---|---|
| 1,900,086 | 3/1933 | Weir | 123/51 AA |
| 1,919,572 | 7/1933 | Schmaljohann | 123/53 C |
| 2,607,328 | 8/1952 | Jencick . | |
| 2,896,596 | 7/1959 | Abraham . | |
| 3,394,683 | 7/1968 | Erick . | |
| 4,037,572 | 7/1977 | Franz | 123/51 AA |
| 4,216,747 | 8/1980 | Noguchi et al. | 123/51 BA |
| 4,305,349 | 12/1981 | Zimmerly | 123/51 BB |
| 4,419,969 | 12/1983 | Bundrick, Jr. | 123/48 R |
| 4,753,198 | 6/1988 | Heath | 123/51 AA |

*Primary Examiner*—David A. Okonsky
*Attorney, Agent, or Firm*—John J. Leavitt

[57] ABSTRACT

Presented is an internal combustion engine that utilizes horizontally opposed pistons operating in direct opposition to one another in axially aligned open ended cylinders suspended below a base plate and arranged generally symmetrically on opposite sides of a vertical plane coincident with the rotational axis of a longitudinally extending main power crankshaft also suspended for rotation below the base plate. A pair of auxiliary crankshafts are provided spaced on opposite sides of the vertical plane and having rotational axes that lie in a common plane below and parallel with the plane of the base plate and coincident with the longitudinal axis of the cylinders. A cam shaft is provided to be driven by at least one of the auxiliary crankshafts in timed sequence with linear displacement of the pistons and operation of poppet-type intake and exhaust valves actuated by the cam shaft to admit a fuel mixture into the combustion chamber defined by the juxtaposed heads of the pistons. Sparkplugs are provided for igniting the compressed fuel mixture in each of the cylinders in appropriately timed intervals to effect displacement of the pistons in a power stroke. Connecting rods pivotally connect each of the pistons with an associated auxiliary crankshaft, and power connecting rods connect each of the auxiliary crankshafts with the main power crankshaft whereby rotation of the auxiliary crankshafts by linear displacement of the pistons effects complementary rotation of the main power crankshaft.

7 Claims, 9 Drawing Sheets

HORIZONTALLY OPPOSED INTERNAL COMBUSTION ENGINE

BACKGROUND OF THE INVENTION

1. Field of the Invention

This invention relates to internal combustion engines, and particularly to such engines incorporating horizontally opposed pistons.

2. Description of the Prior Art

A preliminary patentability and novelty search conducted in connection with the subject invention has revealed the existence of the following United States patents:

| | | |
|---|---|---|
| 4,419,969 | 3,394,683 | 2,896,596 |
| 4,305,349 | 4,216,747 | 2,607,328 |

U.S. Pat. No. 2,607,328 appears to be an improvement on the well known Junkers-type diesel engine, the inventor claiming for this engine the capability of securing more power from less space than is true of the conventional Junkers engine. Additionally, the inventor claims to use fewer parts, thus increasing the reliability of the engine. As seen from the patent, while this engine appears to utilize opposed pistons, these pistons are arranged verically rather than horizontally as in my invention.

U.S. Pat. No. 2,896,596 discloses a double piston internal combustion engine, in which the pistons operate horizontally rather than vertically as in the previous patent. Obviously, this patent teaches the concept of horizontally opposed pistons, including specific ways of providing exhaust and intake ports to the cylinder in which the pistons operate, but other important differences exist between the horizontally opposed internal combustion engine of my invention and the engine disclosed by this patent.

U.S. Pat. No. 3,394,683 combines the concept of a radial engine with the concept of an opposed piston engine, with the pistons and cylinders arranged in a substantially hexagonal pattern. Adjacent pairs of pistons are opposed to each other with a combustion chamber disposed between the tops of the adjacent pistons.

U.S. Pat. No. 4,216,747 discloses what is described as a uniflow double opposed piston-type, two cycle internal combustion engine with pistons operating horizontally in a common cylinder from crank chambers attached to the ends of the cylinder.

U.S. Pat. No. 4,305,349 teaches the concept of multiple pairs of horizontally opposed pistons interconnected by appropriate levers, which are in turn connected to a single crank to effect operation of the pistons.

U.S. Pat. No. 4,419,969 relates to a horizontally opposed internal combustion engine that incorporates a means for adjusting the cylinder head compression to accommodate different types of fluid fuels.

It has been stated that it is very difficult to decide just who invented the internal combustion engine, and that such an invention cannot be considered the creation of one person and this achievement cannot therefore be assigned to one particular nation. It is clear, however, that the studies of Barsanti and Matteucci (as well as those of Lenoir, Brown, and others) contributed to the development of the internal combustion engine. Barsanti and Matteucci are reported to have issued a patent on a counter-opposed piston engine as early as 1858. Lenoir also is reported as having patented a "gas explosion engine" as early as 1858.

However, the evolution of the internal combustion engine has progressed year by year since that time, by incremental improvements until the development of today's highly efficient and high RPM-type internal combustion engines.

Present day gasoline and diesel fuel engines, although highly efficient when compared to older internal combustion engines, utilize only a part of the available power from the fuel that is consumed, the remainder being dissipated in heat and absorbed by the engine block, cylinder head, cylinder head bolts and gaskets, instead of reacting against the pistons to deliver rotational power to the crankshaft. Accordingly, it is one of the important objects of the present invention to provide a horizontally opposed internal combustion engine designed to increase the efficiecy of the engine by eliminating absorption of a large proportion of the power that is generated by the combusting fuel.

It is generally true in engine technology that the greater number of pistons and comlementary cylinders an engine contains, the less vibration is provided in the engine by the rotating and linearly reciprocating parts. Accordingly, another object of the present invention is the provision of an internal combustion engine incorporating horizontally opposed pistons connected by connecting rods to auxiliary crankshafts which are in turn connected by additional connecting rods to a primary power drive or crankshaft.

In a conventional internal combustion engine, whether that engine be sixteen cylinders or two cylinders, part of the reason for the vibration generated in the engine is the action of the pistons reciprocating in the cylinders, in one direction being impelled by the exploding fuel/air mixture, with consequent high pressures being imposed on the rotating crankshaft, while in the opposite direction of travel, the pistons possess an inertia that imposes additional impact forces on the crankshaft and through the crankshaft on the engine block. Accordingly, still another object of the present invention is a horizontally opposed internal combustion engine in which the forces exerted by the pistons and connecting rods on the crankshafts are balanced to minimize the generation of vibrational forces.

A still further object of the present invention is the provision of an internal combustion engine having at least one pair of horizontally opposed, axially aligned operating in a common cylinder, and which may be produced with multiple pairs of horizontally opposed pistons and cylinders, dependent upon the power requirements for a particular engine.

The invention possesses other objects and features of advantage, some of which with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the horizontally opposed internal combustion engine of the invention comprises a housing within which is enclosed at least two pairs of horizontally opposed pistons, each of the pistons of each pair being connected to an auxiliary crankshaft through an appropriate auxiliary connecting rod, with a primary connecting rod connecting the auxiliary crankshafts to a centrally disposed main power crankshaft that receives rotational torque from the auxiliary crankshafts. The piston and auxiliary crankshaft assemblies, connected as they are by auxiliary connecting rods, are enclosed within a relatively light sheet metal housing which functions also as a sump for the containment of oil for lubricating the mechanism. The relatively light housing is closed at its upper end by a relatively heavy metal mounting plate from which the cylinder assembly is suspended, and which provides an appropriate water jacket for cooling the cylinders. Appropriate valve ports and valve assemblies are provided for controlling the admission of a combustible fuel to the combustion chambers formed between each pair of horizontally opposed pistons. It is important to note that the horizontally opposed pistons are arranged in pairs that operate within a common cylinder so that when the fuel charge between the two pistons ignites, the pressure generated by combustion acts directly against the opposing piston heads without an intervening structure.

Figure 8:
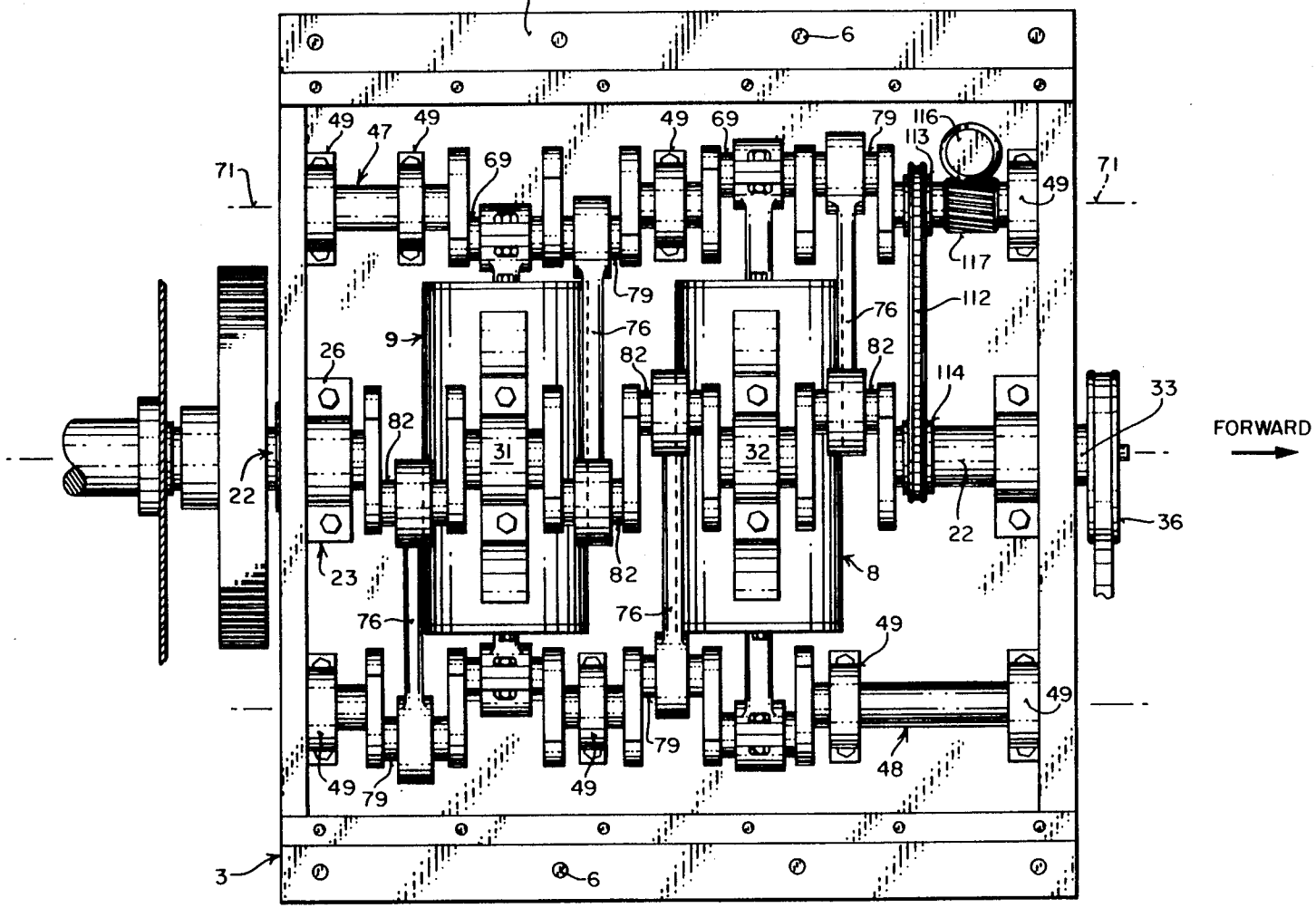
FIG. 8 is a bottom plan view of the internal combustion engine with the oil pan removed to expose the auxiliary crankshafts and main power crankshaft.
Figure 9:
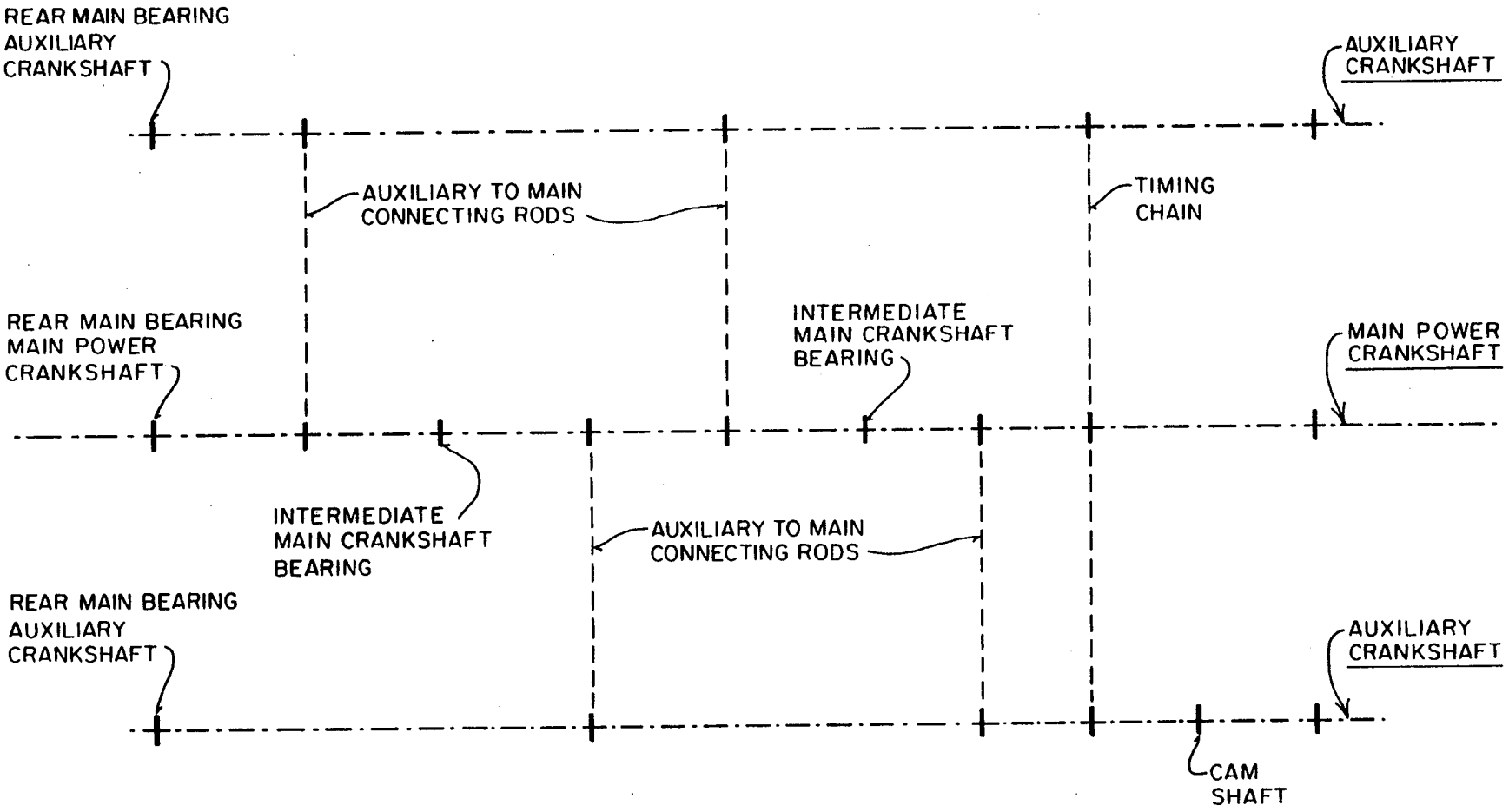
FIG. 9 is a schematic view in the plan illustrating the locations of journal bearings for the auxiliary crankshafts and main power crankshaft and piston connecting rod journals on the auxiliary crankshafts, viewed from above.

This view is largely a mirror image of FIG. 8, but strictly schematic.

DESCRIPTION OF THE PREFERRED EMBODIMENT

In terms of greater detail, the exceedingly simple and efficient internal combustion engine of the invention eliminates the massive monolithic cast engine block that is conventionally used in gas and diesel internal combustion engines. The internal combustion engine of the invention is designed for economical manufacture and assembly and facility of installation in the framework of an internal combustion vehicle, in addition to efficiency in operation.

Referring to the drawings, it will be seen that the internal combustion engine of this invention is generally organized around a main engine mounting plate designated generally by the numeral 2, and being conveniently quadrilateral in its configuration, being either square or rectangular, with its peripheral marginal portions 3 having mounting bores 4 through which extend mounting cap screws or bolts 6 that penetrate the peripheral edge portions 3 of the main engine plate 2 and thread into the framework 7 as shown.

Figure 4:
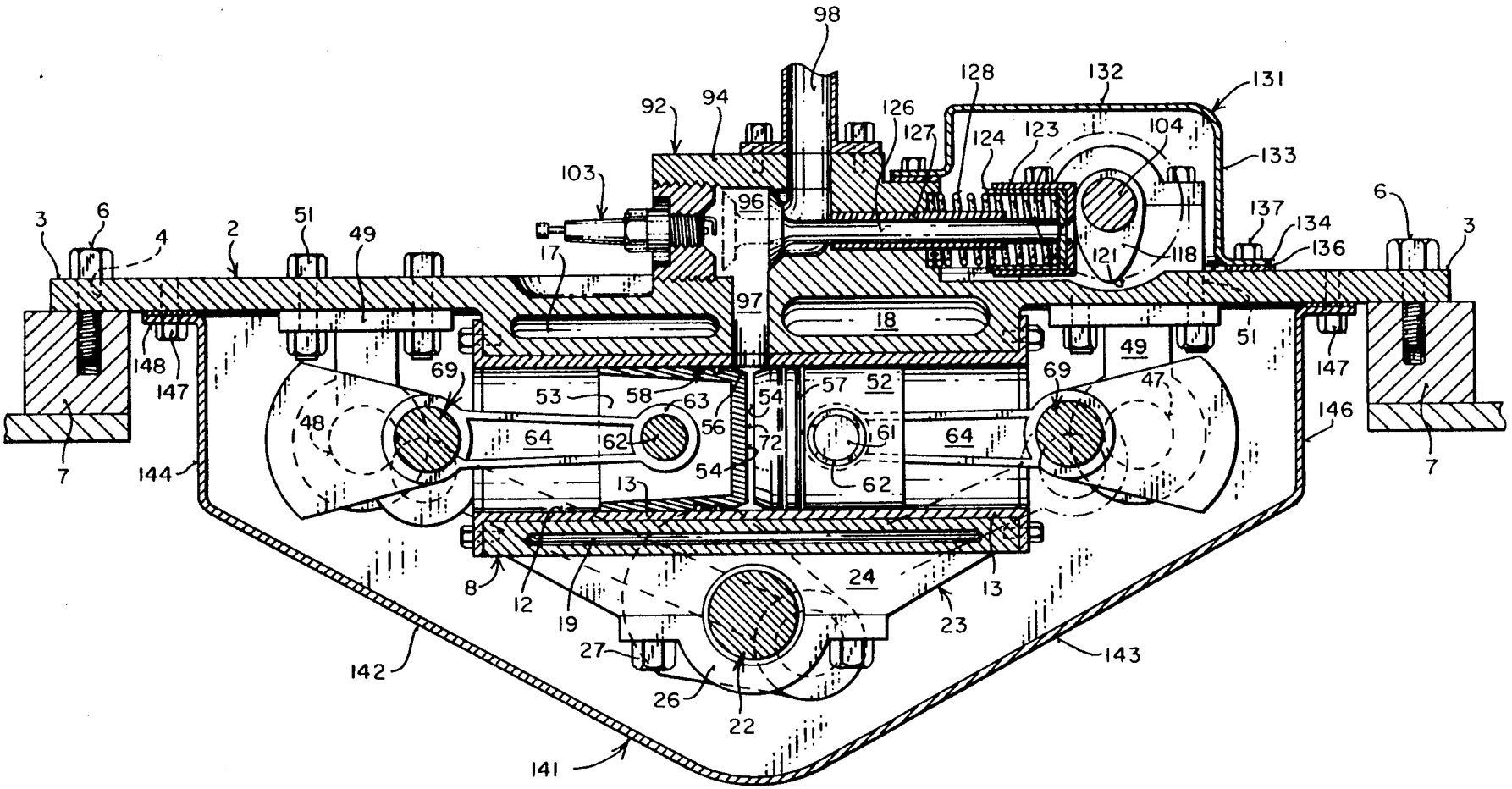
FIG. 4 is a vertical cross-sectional view in the plane indicated by the line 4—4 in FIG. 1, coincident with the longitudinal axis of a pair of opposed cylinders of the internal combustion engine.
Figure 5:
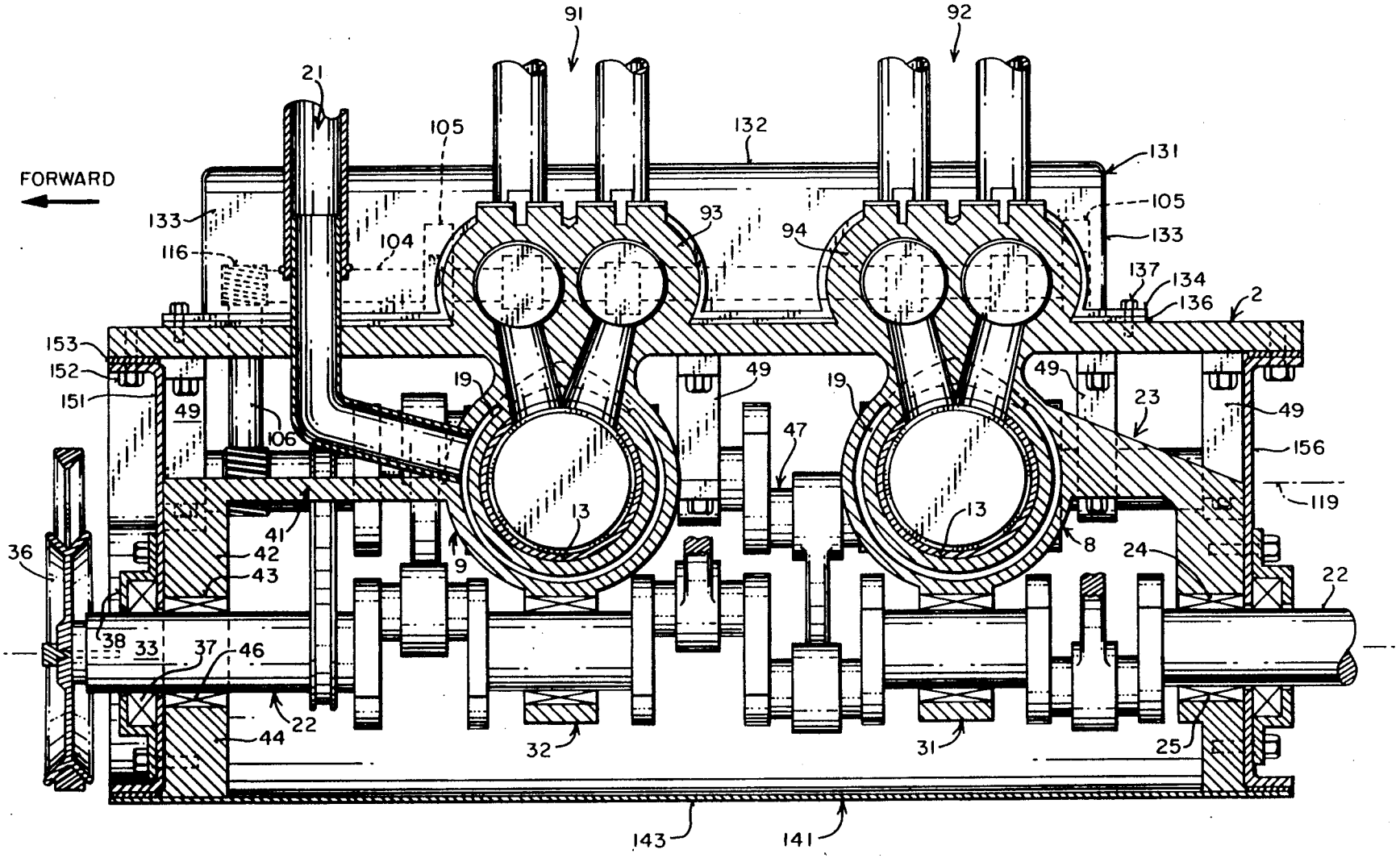
FIG. 5 is a vertical cross-sectional view in the plane indicated by the line 5—5 in FIG. 2, coincident with the longitudinal axis of the main power crankshaft of the internal combustion engine.
Figure 6:
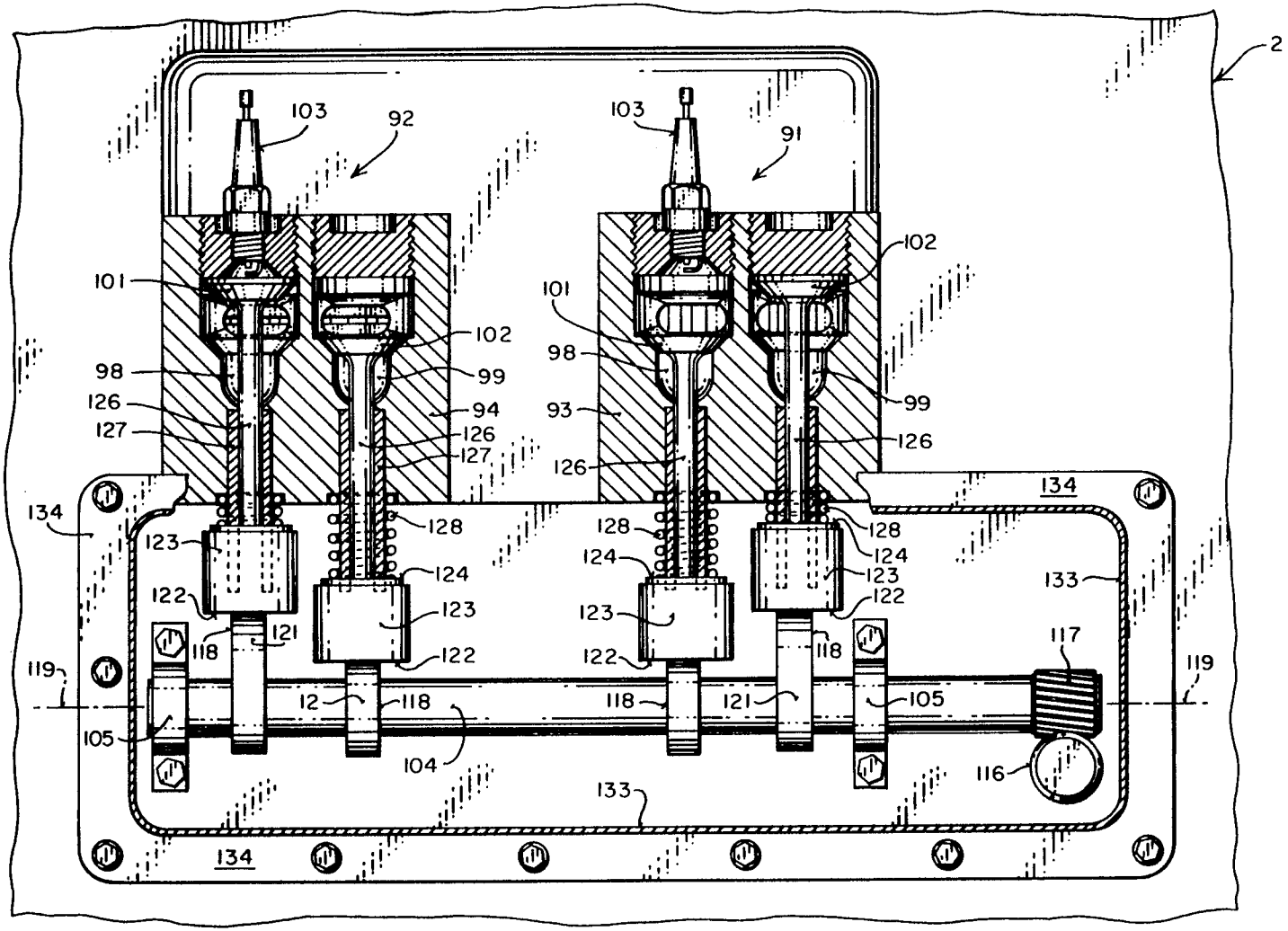
FIG. 6 is a fragmentary plan view of the valve gallery of the internal combustion engine.
Figure 7:
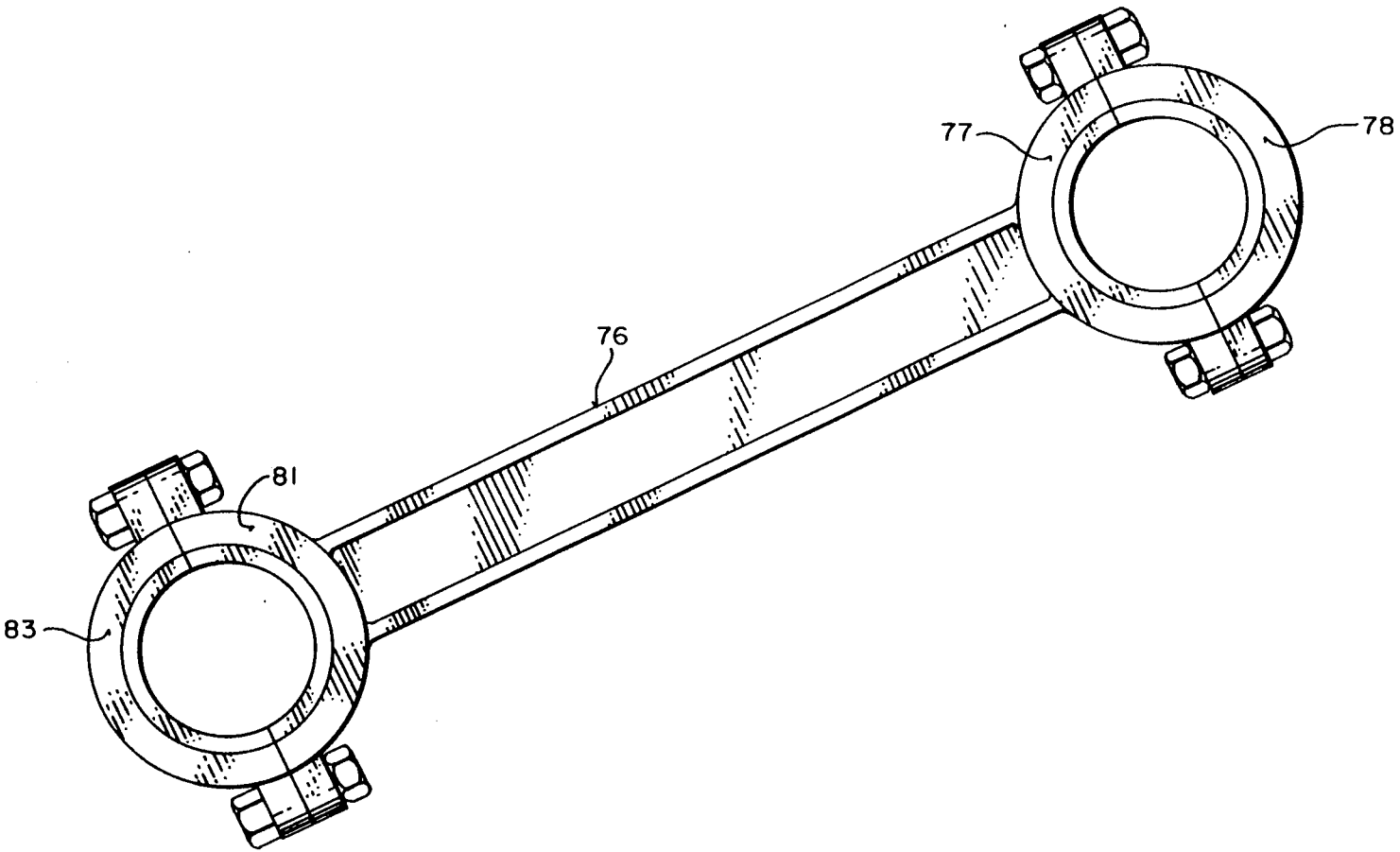
FIG. 7 is an elevational view of one of the power connecting rods that connect an auxiliary crankshaft to the main power crankshaft.

Generally centrally disposed on the main engine mounting plate 2, and depending therebelow as illustrated in FIGS. 4 and 5, are two integral projections indicted generally by the numerals 8 and 9, each of the projections constituting an integral projection from the plate 2, die cast or sand cast, and each defining an elongated cylindrical recess designated by the numeral 12. Within each of the cylindrical recesses 12 there is inserted a piston sleeve designated generally by the numeral 13, as shown in FIGS. 4 and 5, each of the sleeves being inserted from one end of the associated recess 12, and secured in the cylindrical recess 12 by appropriate cap screws 16 as shown. For ease in insertion amd removal, the cylindrical sleeves 13 are snug press fits within their respective recesses 12, and removal of the cap screws 16 enables relatively easy withdrawal of the sleeves while preventing inadvertent rotation thereof in relation to the cylindrical recess within which they are fitted.

Because in any internal combustion engine a certain amount of heat is generated, the projections 8 and 9 that extend below or are suspended below the main motor support plate 2, are provided with appropriate coolant passageways 17, 18 and 19, as shown in FIGS. 4 and 5, the passageways being interconnected and connected in common with a source of fluid or coolant through the inlet passageway designated generally by the numeral 21.

Figure 3:
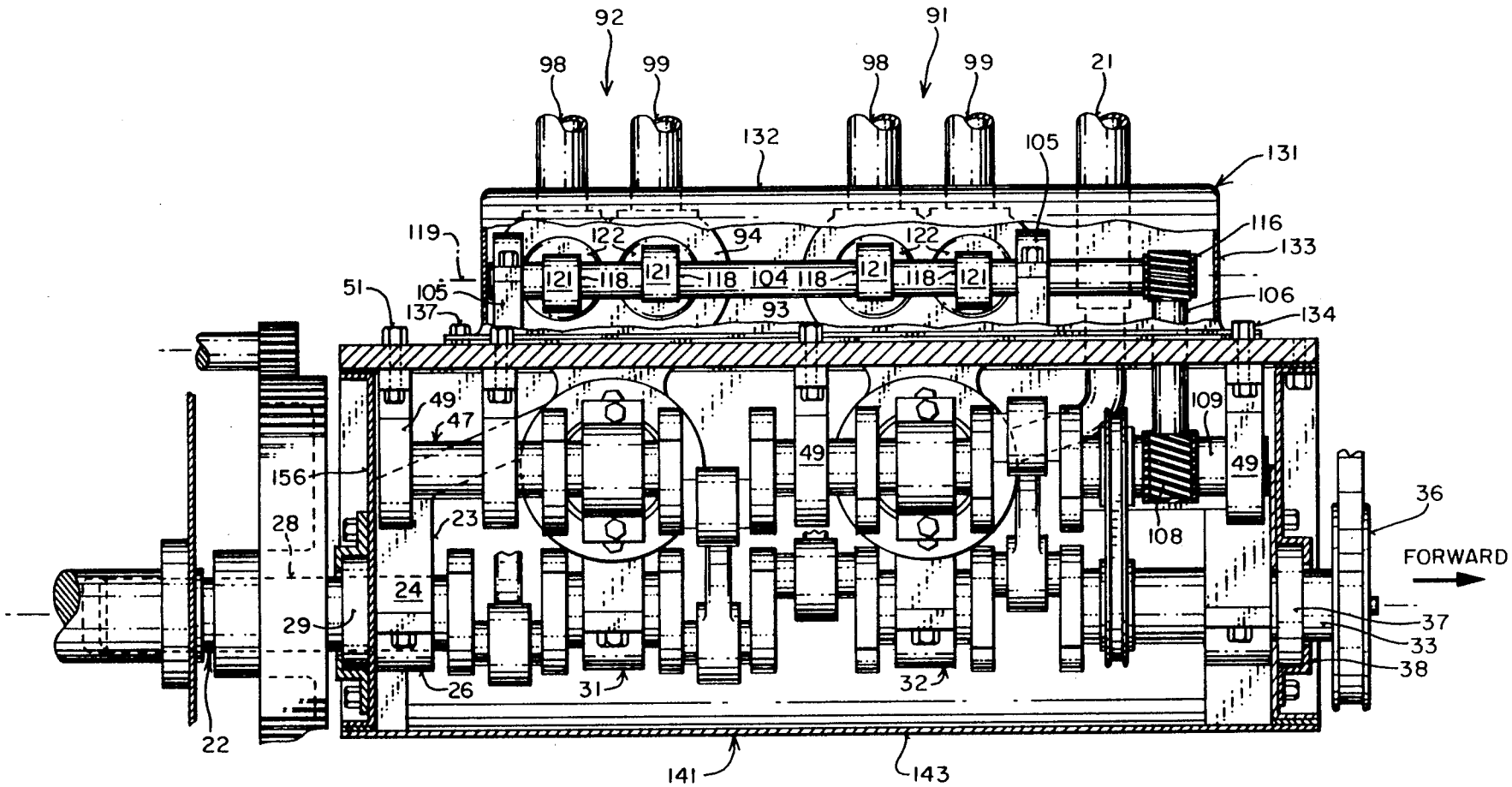
FIG. 3 is a vertical cross-sectional view in the plane indicated by the line 3—3 in FIG. 2, coincident with the longitudinal axis of the main power crankshaft of the internal combustion engine.

To transmit power from the internal combustion engine, there is provided a main or power crankshaft designated generally by the numeral 22 positioned below the motor mounting plate 2, and generally centrally disposed between the peripheral edges thereof so that the main or power crankshaft extends longitudinally of the engine. This relationship of the crankshaft to the mounting plate is illustrated in FIGS. 3, 4 and 8, substantially the full length of the crankshaft 22 is illustrated in FIGS. 3,5 and 8. Referring to FIGS. 3, 5 and 8, it will there be seen that at the rear end of the engine, viewed to the left in FIGS. 3 and 8 and to the right as viewed in FIG. 5, there is provided an integral rear main bearing bracket designated generally by the numeral 23, the bracket at one end being integral with the downwardly projecting bearing support 8, and at its opposite end providing a rear main bearing cradle 24 within which the journal portion of the crankshaft is rotatably journaled, there being provided a bearing cap 26, with appropriate cap screws 27 threadably engaging the bracket portion 23 and the cradle 24 to support the crankshaft at this end of the engine. Interposed between the cradle 24 and the bearing cap 26, there is a replaceable bearing shell 25 as is which may conveniently be replaced after extended use and any appreciable wear beyond efficient operating tolerances. This construction is illustrated in FIG. 3, where the tail portion 28 of the crankshaft 22 is illustrated as extending through the end wall of the engine housing and equipped with an oil seal ring 29 encased in an appropriate housing as illustrated, which is detachably secured to the end wall of the housing by appropriate caps screws as shown. The tail portion 28 of the main power crankshaft is appropriately splined or provided with keyways to which may be detachably secured additional equipment, such as components associated with a power transmission, which forms no part of this invention and is therefore not discussed herein.

Again referring to FIG. 3, it will be seen that in addition to the rear main support bearing bracket 23 and the bearing saddle 24, the internal combustion engine of the invention is also provided with at least two additional crankshaft support bearings, here designated generally by the numerals 31 and 32, the crankshaft support bearings 31 and 32 being intermediate support bearings, the crankshaft extending forwardly to terminate in a drive portion 33 on which is mounted for rotation with the crankshaft a drive pulley 36 as shown. Intermediate the crankshaft bearing 32 and the terminal or drive portion 33 of the crankshaft, there is interposed an oil seal assembly 37 detachably held in place about the crankshaft by an appropriate bracket 38 detachably secured to the front wall of the internal combustion engine.

To further support the main power crankshaft 22 at the forward end of the engine, there is provided a bearing bracket (FIG. 5) integral with the cylinder projection 9 and designated generally by the numeral 41. The bearing bracket 41 extends forwardly and integrally from the cylindrical projection 9 and provides a downwardly projecting bearing portion 42 forming a cradle 43 for the front portion of the main crankshaft, and equipped with a bearing cap 44 secured to the bearing cradle 43 by appropriate cap screws. As with other bearing members, there is interposed between the bearing 43 and the bearing cap 44 an appropriate bearing shell 46. It will thus be seen that the main power crankshaft is rotatably supported at fore and aft positions adjacent the fore and aft ends of the engine, and is additionally supported at two intermediate positions by the intermediate bearings 31 and 32.

In conventional engines, rotary motion of the main power crankshaft is secured by the conversion to rotary moments of force the linear motion of pistons and associated connecting rods that are connected directly to crankshaft "throws" that are radially offset from the rotative axis of the crankshaft. Thus, upon explosion of the fuel/air mixture delivered to the combustion chamber, the piston moves away from the combusion chamber, exerting an axial force on the associated connecting rod, the opposite end of which remote from the piston is rotatably connected to a crankshaft "throw." In contrast to conventional internal combustion engines in which the piston connecting rod is connected directly to the main power crankshaft "throw", in the internal combustion engine of the present invention, an intermediate or auxiliary crankshaft is provided for each bank of pistons, each of the auxiliary crankshafts receiving rotative torque from the associated piston rods, and through appropriate means which will hereinafter be explained, transferring that rotative torque through additional power connecting rods that rotatably interconnect the auxiliary crankshafts with the main power crankshaft.

Thus, referring to FIGS. 4 and 8, it will be seen that there are first and second auxiliary crankshafts designated generally by the numerals 47 and 48, respectively, the auxiliary crankshafts 47 and 48 extending longitudinally of the internal combustion engine, parallel with the main crankshaft 22, and each being rigidly but rotatably supported on the main engine mounting plate 2 by appropriate pillow-block type bearings 49 detachably secured by appropriate bolts 51 to the underside of the motor mounting plate 2 as shown. Referring to the auxiliary crankshaft 47 which is illustrated in its full length in FIGS. 3 and 8, it will be noted that in addition to the front and rear pillow-block bearing assemblies, there is provided at least one additional intermediate pillow-block assembly 49 so as to absorb the transverse impact shocks that are imposed on the auxiliary crankshaft by operation of the engine to convert linear motion of the piston and connecting rod assemblies to rotary motion of the auxiliary crankshafts, and through the auxiliary crankshafts, transmit such rotary torque to the main crankshaft 22.

To generate a rotative torque in the auxiliary crankshafts 47 and 48 of the instant invention, there are provided in each of the cylinders 13 which are shown in FIGS. 3, 5 and 8 to be horizontally arranged side-by-side, a pair of pistons 52 and 53, the pistons being horizontally opposed in their respective end portions of cylinder 13, each piston having an inner end surface 54 which constitutes the head-end of the piston, which is, as shown in FIG. 4, chamferred or rabbetted around its circular periphery at 56 adjacent the inner end surface 54, for a reason which will hereinafter appear. Additionally, each of the pistons is provided with appropriate piston rings 57, and 58, these rings combining to provide the necessary compression and oil sealing about the circular periphery of each piston adjacent its inner end as it reciprocates within its respective cylinder.

With respect to the piston 52 and the auxiliary crankshaft 47, it will be seen that the piston 52 is provided with a wrist-pin 61 appropriately rotatably mounted in a wrist-pin bearing 62 the central portion of which is interrupted so as to give access to the center portion of the wrist pin 61 by the bearing end 63 of the connecting rod 64. The opposite end of the connecting rod 64 is provided with a bearing saddle 66 constituting a semi-cylindrical surface adapted to receive a bearing shell 67, the opposite side of the semi-cylindrical surface of the bearing 66 being provided with a cap 68 suitably secured to the bearing portion 66 by suitable cap screws or nut-and-bolt assemblies. As illustrated in FIGS. 3, 4 and 8, the bearing assembly 66–68 is rotatably clamped to an auxiliary crankshaft "throw" 69 offset from the center of rotation 71 of the auxiliary crankshaft 47, so that as the piston 52 moves horizontally from its position at top-dead-center as illustrated in FIG. 4, a rotary moment is imposed on the auxiliary crankshaft 47 through the connecting rod 64 and the crankshaft "throw" 69.

In the same manner, referring to the piston 53, which is in axial alignment with the piston 52, the tops or ends of the pistons 54 are in near abutment when both pistons are in top-dead-center position as shown. There is only a relatively narrow combustion space 72 between the tops of the opposed pistons, both of which are chamferred or rabbetted as shown by the chamber 56 to provide an annular combustion chamber about each of the juxtaposed piston ends so that as combustion occurs, it communicates itself to the space 72 between the ends of the two pistons. In the interest of brevity in this description, a detailed description of the piston 53 and its corresponding connecting rod is not discussed in detail, it being understood that the two piston assemblies operate in unison, the piston 52 imposing a rotary moment on the auxiliary crankshaft 47, while the piston 53 through its associated connecting rod, imposes a rotary moment on the auxiliary crankshaft 48.

Referring to FIGS. 3, 4 and 8, it is noted that the auxiliary crankshaft 47 is rotatably supported at spaced intervals on the bearing brackets 49, as previously described, and receives a rotary moment of force by the linear displacement of the pistons 52, of which there are two in the present four cylinder engine, while the auxiliary crankshaft 48 receives the imposition of a rotary moment of force by the linear translation of the pistons 53, of which there are also two, the pistons 52 and 53 being arranged as horizontally opposed pairs driving complementary auxiliary crankshafts as previously described.

To transfer the rotative moment of force that is imposed on the auxiliary crankshafts 47 and 48 to the main power crankshaft 22, there is provided on each auxiliary crankshaft a spaced pair of power connecting rods designated generally by the numeral 76. Each end of the power connecting rod associated with the auxiliary crankshaft is provided with an appropriate bearing saddle 77 and complementary cap 78 adapted to rotatably engage the offset crankshaft "throw" 79 formed on the auxiliary crankshaft. The degree of offset of the "throw" from the axis of rotation of the auxiliary crankshaft determines the amount of force that is transmitted from the auxiliary crankshaft 47 to the main power crankshaft 22 through the power connecting rod 76. The end of the power connecting rod opposite the interconnection thereof with the auxiliary crankshaft 47 is provided by a bearing saddle 81 rotatably connected to the offset "throw" 82 of the main crankshaft 22, the union of the connecting rod 76 to the main crankshaft being completed by the application of a bearing cap 83. In the interest of brevity in this description, it should be understood that the second pair of power connecting rods 76 spaced from the first pair of connecting rods 76 are attached to a complementary "throw" on the auxiliary crankshaft 48 and a cooperating "throw" on the main power crankshaft 22 in the same manner as described above.

Also in the interest of brevity in this description, it should be noted that the auxiliary crankshaft 48 is constructed very similar to the crankshaft 47, and is connected to its respective pistons so as to receive rotary moments of force from the axial translation thereof in the same manner that the piston connecting rod 64 connects the wrist-pin 61 of the piston 52 to the auxiliary crankshaft "throw" 69.

Figure 1:
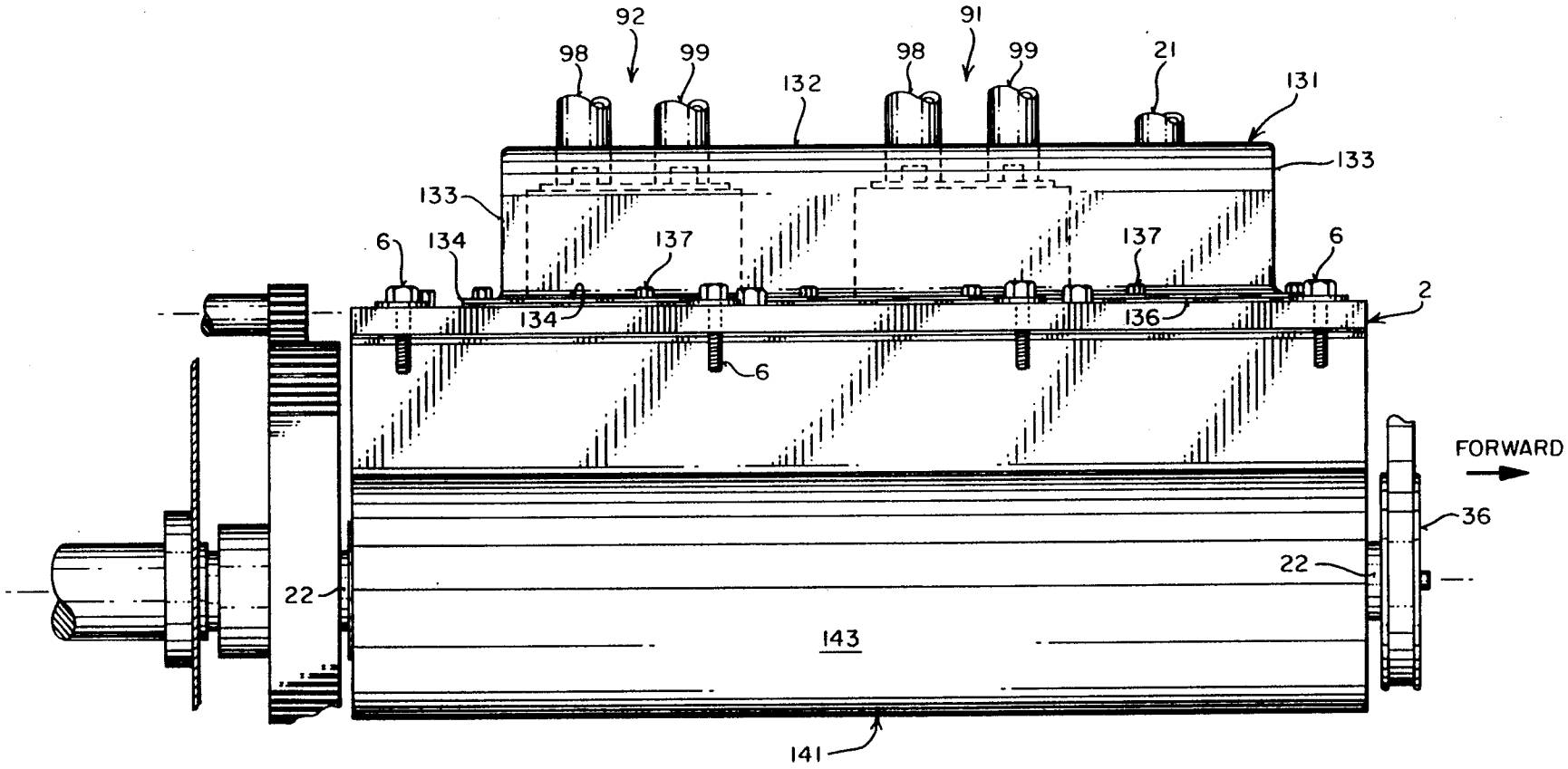
FIG. 1 is a side elevational view in reduced scale of the internal combustion engine.
Figure 2:
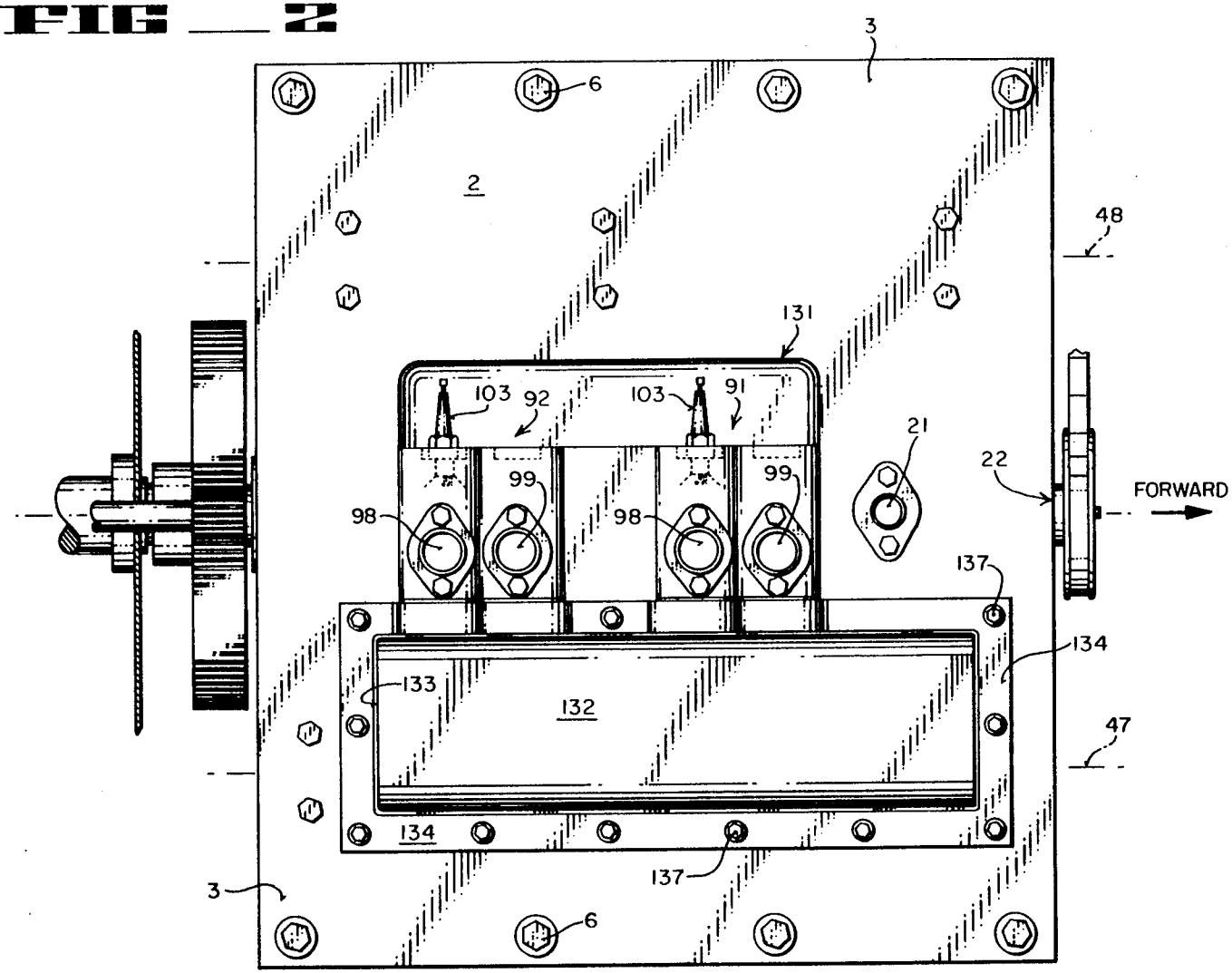
FIG. 2 is a plan view in reduced scale of the internal combustion engine.

To control the admission of combustible fuel to the engine, there is provided a pair of spaced valve galleries designated generally by the numerals 91 and 92, the valve galleries being formed within integral extensions 93 and 94 of the main engine plate 2 in a direction opposite the extension of the integral projections 8 and 9 that depend below the plate 2. In connection with the valve galleries 91 and 92, the plate extensions 93 and 94 are each provided with an internal combustion chamber 96 which communicates by a vertically extending passageway 97 with the annular combustion chamber 56 formed about the head-end of each of the horizontally opposed pistons 52 and 53, the passageway 97 also communicating with the combustion chamber 72 formed between the two pistons when they are in top-dead-center position as shown in FIG. 2.

The combustion chamber 96 also communicates with fuel intake manifold ports 98 and exhaust ports 99, the intake manifold ports into the combustion chamber being controlled by appropriate poppet-type valves 101, while the exhaust manifold ports are controlled by appropriate poppet-type valves 102. To ignite the fuel mixture admitted to the combustion chamber 96, there is provided a sparkplug 103, the electrodes of which project into the combustion chamber to ignite the fuel mixture under control of an approprite electrical spark distributor system forming no part of this invention and therefore not illustrated or described.

Suffice to say that the electrical spark distributor system will operate in conjunction with a cam shaft 104 extending longitudinally of the engine above the main engine plate 2 as shown in FIGS. 3, 4, 5 and 6. Obviously, the cam shaft 104 is rotatably journaled in appropriate journal bearings 105 that detachably secure the cam shaft to the top surface of the main engine plate 2. To secure timed rotation of the cam shaft in concert with the main power crankshaft and the two auxiliary crankshafts, the cam shaft is connected to at least one of the auxiliary crankshafts by a suitable drive shaft 106 rotatably journaled in the main engine plate 2, and depending into the engine compartment as shown in FIG. 3 to place the drive end 108 of the drive shaft in driving relation to the drive end 109 of the auxiliary crankshaft 47 as shown.

Rotation of the auxiliary crankshaft 47 in time with the main drive crankshaft is achieved by interconnecting the main drive crankshaft with the auxiliary crankshaft 47 by means of a timing belt 112 of the toothed variety to eliminate slippage of the timing belt and thus accurately maintain the engine correctly timed so that all rotating and reciprocating parts operate in unison and cooperatively. The timing belt 112 runs over appropriate gears 113 and 114 fixed on the auxiliary crankshaft 47 and the main power crankshaft 22, respectively. At its upper end, the cam drive shaft 106 is provided with a toothed drive portion 116 that meshes with a complementary pinion 117 keyed on the cam shaft, thus transferring rotary torque to the cam shaft in a timed manner correlated to the rotation of the main crankshaft and the auxiliary crankshafts to thus time opening and closing of the intake and exhaust valves 98 and 99 with the displacement of the pistons in their intake and exhaust strokes.

The cam shaft 104 is provided with lobes 118 that extend transverse to the rotative axis 119 of the cam shaft, each of the lobes being provided with a cam surface 121 adapted to impinge against the top surface 122 of a spring-pressed cam follower cup 123 within which is slidably positioned a secondary cup 124 having a top surface that normally lies in abutment against the inside surface of the cam follower cup 123. Both top walls of the cups 123 and 124 are apertured as shown for the admission of lubricating oil to lubricate the stem 126 of the valve, which reciprocates in the valve guide sleeve 127 press-fitted into the body of the valve gallery as shown. A valve spring 128 is provided surrounding the associated end of the valve guide and valve stem and at one end impinging resiliently against the valve gallery and at its opposite end impinging resiliently against the bottom of the inner cup 124 as shown.

To enclose the operating components of the internal combustion engine of the invention, there is associated with the cam shaft and associated valve lifters (122–124 and 126–128) a valve housing member designated generally by the numeral 131 and including a top panel 132 surrounded by integral wall portions 133 forming a cavity within which the cam shaft and operating portions of the valve lifters are enclosed. The surrounding wall portions terminate remote from the top panel in peripheral flanges 134 which are sealingly secured to the associated surfaces of the engine plate 2 and the valve galleries with gaskets 136 by a series of cap screws 137.

On its underside, the engine is enclosed by an oil pan designated generally by the numeral 141, the oil pan having converging bottom panels 142 and 143, and vertically depending side wall members 144 and 146. The oil pan is detachably secured to the underside of the main engine plate 2 by appropriate cap screws 147 engaging peripheral flange 148 and the underlying gasket 149 as shown.

At the forward end of the engine, the oil pan is provided with a front wall 151 suitably apertured to sealingly receive the forward end of the crankshaft as shown. The front wall 151 is sealingly bolted by cap screws 152 and gasket 153 to the underside of the peripheral portion 3 of the main engine plate 2 as shown. A similarly constructed rear end wall 156 closes the rear end of the oil pan to thus totally and sealingly enclose the operting components of the engine that depend below the underside of the main engine plate 2.

Having thus described the invention, what is believed to be new and novel and sought to be protected by Letters Patent of the United States is as follows.

I claim:

1. An internal combustion engine, comprising:

a) a base plate coincident with a horizontal plane and generally symmetrical with respect to a central longitudinal axis coincident with a vertical plane extending between fore and aft ends of the base plate, said base plate having peripheral mounting portions for detachable support of the base plate on the frame of a vehicle;

b) a main power crankshaft suspended below said base plate and extending parallel with said central longitudinal axis, the axis of rotation of said main power crankshaft being coincident with said vertical plane;

c) a plurality of open-ended piston cylinders disposed below said base plate arranged in axially aligned pairs, the piston cylinders of each pair being symmetrical about a horizontal axis disposed between the plane of said base plate and the rotational axis of said main power crankshaft;

d) a pair of auxiliary crankshafts detachably journaled below said base plate on opposite sides of said vertical plane for rotation about longitudinal axes of rotation parallel with the axis of rotation of said main power crankshaft;

e) a connecting rod assembly pivotally interconnecting said pair of auxiliary crankshafts with said main power crankshaft whereby rotation of said auxiliary crankshafts results in rotation of said main power crankshaft;

f) a piston assembly in each of said cylinders operatively connected with the associated auxiliary crankshaft and including a piston having a head, a wrist-pin and a connecting rod connecting the wrist-pin of each piston with the associated auxiliary crankshaft whereby linear reciprocation of said pistons in said piston cylinders effects rotation of said pair of auxiliary crankshafts and said main power crankshaft;

g) a fuel induction assembly for admitting a combustible fuel mixture into said cylinders between the opposed heads of said pistons in a controlled sequence correlated to the receding movement of said pistons in said cylinders in a fuel intake stroke;

h) means for igniting the fuel mixture compressed between the juxtaposed heads of said pistons upon completion of a compression stroke during which the opposed piston heads move into juxtaposed relationship to define a combustion chamber therebetween, whereby said juxtaposed heads of said pair of pistons are driven apart in a power stroke by the pressure exerted by the combusting fuel mixture in said combustion chamber to thereby impose a rotary moment of force on the associated auxiliary crankshafts;

i) means for exhausting from said cylinders the products of combustion of said fuel mixture in correlation to the movement of said pistons in an exhaust stroke; and j) means including an oil pan enclosing said auxiliary crankshafts, said main power crankshaft and said piston and piston cylinder assembly and suspended from the underside of said base plate for containing a quantity of oil to lubricate the internal combustion engine.

2. The internal combustion engine according to claim 1, wherein said combustion chamber formed between the heads of said pair of pistons is symmetrical with respect to said vertical plane coincident with the rotational axis of said main power crankshaft.

3. The internal combustion engine according to claim 1, wherein the horizontal longitudinal axis of said piston cylinders is coincident with a plane parallel with the plane of said base plate.

4. The internal combustion engine according to claim 1, wherein the axes of rotation of said pair of auxiliary crankshafts lie in a horizontal plane coincident with the horizontal longitudinal axes of said pair of axially aligned piston cylinders.

5. The internal combustion engine according to claim 1, wherein said combustion chamber includes an annular space surrounding the head ends of said pair of axially aligned pistons.

6. The internal combustion engine according to claim 1, wherein said fuel induction system includes a cam shaft rotatably journaled on said base plate and having cam lobes rotatable in a timed sequence correlated to rotation of said auxiliary crankshafts and linear displacement of said pairs of horizontally opposed pistons, and spring-pressed intake valves communicating a source of fuel with said combustion chambers and actuated to open condition by said cam lobes in timed sequence to admit a charge of combustible fuel mixture into said combustion chamber when said pistons are receding in a fuel intake stroke and actuated to closed condition by said cam lobes to effect compression of said fuel mixture by the pistons moving in their compression stroke.

7. The internal combustion engine according to claim 1, wherein said means for exhausting said products of combustion from said cylinders includes a cam shaft rotatably journaled on said base plate and having a plurality of cam lobes thereon rotatable in a time sequence with said auxiliary crankshafts and said main power crankshaft and linearly reciprocable movement of said pistons, and spring-pressed exhaust valves mounted for actuation by said cam shaft to open said exhaust valve when said pistons of said pair move together in an exhaust stroke.

* * * * *